US010227789B2

(12) United States Patent
Spangenberg

(10) Patent No.: US 10,227,789 B2
(45) Date of Patent: Mar. 12, 2019

(54) PLANTED POLE REINFORCEMENT METHODS

(71) Applicant: LOGSYS POWER SERVICES PTY LTD, Joondalup (AU)

(72) Inventor: David Charles Spangenberg, Currambine (AU)

(73) Assignee: LOGSYS POWER SERVICES PTY LTD, Joondalup (AU)

( * ) Notice: Subject to any disclaimer, the term of this patent is extended or adjusted under 35 U.S.C. 154(b) by 0 days.

(21) Appl. No.: 15/533,454

(22) PCT Filed: Dec. 9, 2015

(86) PCT No.: PCT/AU2015/050777

§ 371 (c)(1),
(2) Date: Jun. 6, 2017

(87) PCT Pub. No.: WO2016/090429

PCT Pub. Date: Jun. 16, 2016

(65) Prior Publication Data

US 2017/0370118 A1 Dec. 28, 2017

(30) Foreign Application Priority Data

Dec. 9, 2014 (AU) ..... 2014904985

(51) Int. Cl.
*E04H 12/08* (2006.01)
*E04H 12/22* (2006.01)
*E04G 23/02* (2006.01)

(52) U.S. Cl.
CPC ..... *E04H 12/2292* (2013.01); *E04G 23/0218* (2013.01); *E04H 12/08* (2013.01)

(58) Field of Classification Search
CPC ..... E04H 12/2292; E04H 12/08
See application file for complete search history.

(56) References Cited

U.S. PATENT DOCUMENTS 4,921,555 A * 5/1990 Skiff ..... B29C 73/025 156/215
5,245,812 A * 9/1993 Landers ..... E02D 5/64 52/514

(Continued)

FOREIGN PATENT DOCUMENTS

CH 681097 A5 1/1993
JP 2010-047981 A 3/2010

(Continued)

OTHER PUBLICATIONS

International Search Report of the Ausralian Patent Office dated Feb. 9, 2016.

*Primary Examiner* — Paola Agudelo
(74) *Attorney, Agent, or Firm* — Patshegen IP; Moshe Pinchas

(57) ABSTRACT

A method is described for reinforcing to extend the life of a planted pole, including a metal planted utility pole at risk of, or damaged by corrosion. The method comprising delivering a flowable composition into the hollow of the planted pole, the flowable composition being capable of setting in the hollow at least proximate to the groundline to form a substantially non-flowable composition when set; the set composition comprising reinforcement supports, and being attached to the pole to provide additional support for the planted pole at least proximate to the groundline.

17 Claims, 9 Drawing Sheets

(56) References Cited

U.S. PATENT DOCUMENTS

| | | | | |
|---|---|---|---|---|
| 5,296,187 | A * | 3/1994 | Hackman | B28B 1/523 264/257 |
| 9,410,321 | B2 * | 8/2016 | Ciuperca | E04C 5/12 |
| 2002/0140623 | A1 * | 10/2002 | Harrison | E04H 12/08 343/898 |
| 2003/0157281 | A1 | 8/2003 | Minayoshi et al. | |
| 2004/0031216 | A1 * | 2/2004 | Poldmaa | A62B 35/0068 52/125.2 |
| 2004/0194402 | A1 * | 10/2004 | Payne | E02D 27/42 52/170 |
| 2005/0097855 | A1 * | 5/2005 | Fouad | E04H 12/12 52/843 |
| 2008/0041004 | A1 * | 2/2008 | Gibbar | E04C 2/288 52/309.12 |
| 2009/0173871 | A1 * | 7/2009 | Stott | B28B 7/002 249/33 |
| 2013/0047530 | A1 * | 2/2013 | Durham | B28B 7/186 52/220.1 |
| 2015/0308067 | A1 * | 10/2015 | Seidel | E02D 27/42 405/250 |

FOREIGN PATENT DOCUMENTS

| | | | |
|---|---|---|---|
| JP | 5061260 | B1 | 10/2012 |
| JP | 2013-014966 | A | 1/2013 |
| WO | 2014121281 | A2 | 8/2014 |

* cited by examiner

Figure 5

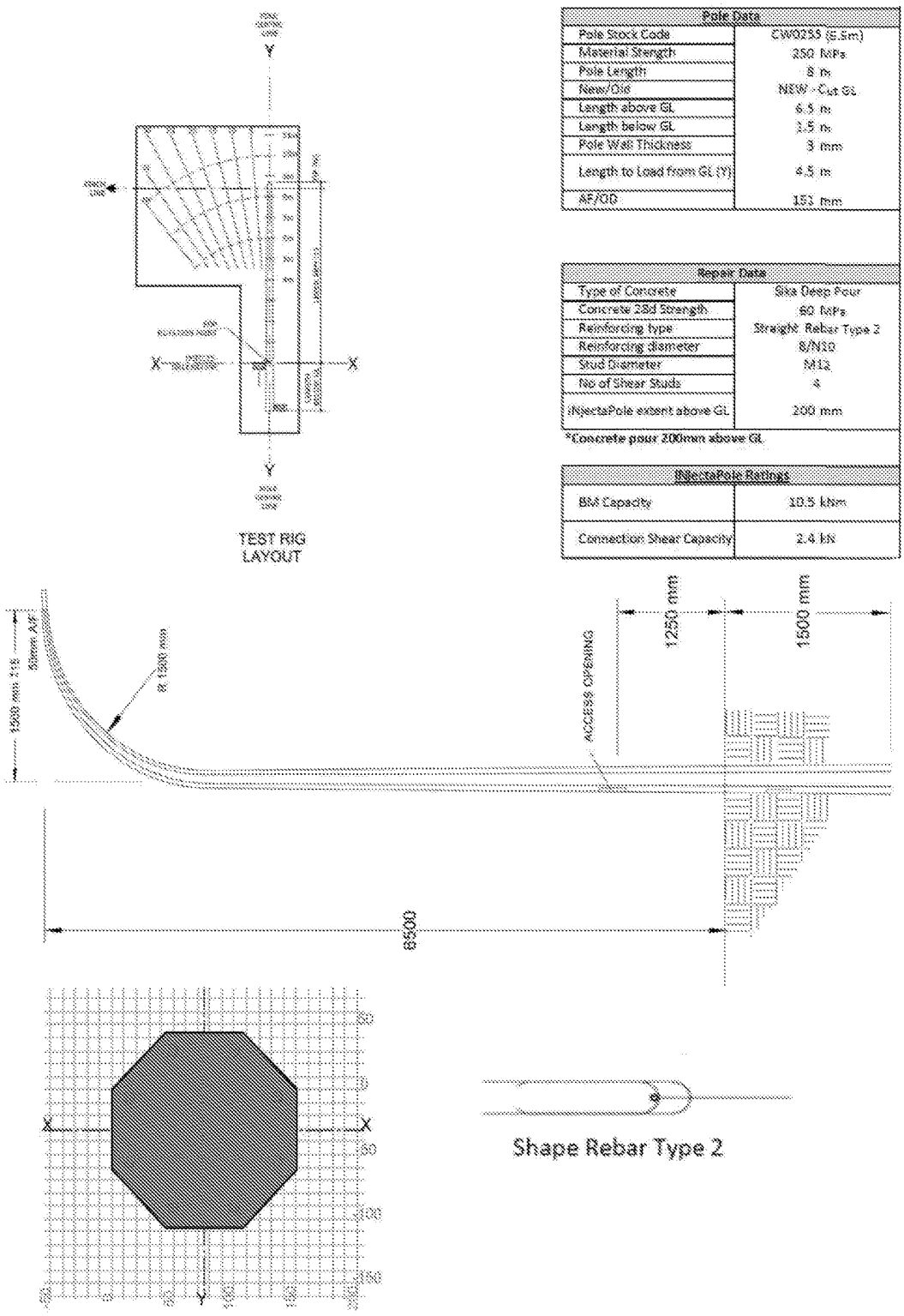

| Pole Data | |
|---|---|
| Pole Stock Code | CW0255 (5.5m) |
| Material Strength | 250 MPa |
| Pole Length | 8 m |
| New/Old | NEW - Cut GL |
| Length above GL | 6.5 m |
| Length below GL | 1.5 m |
| Pole Wall Thickness | 3 mm |
| Length to Load from GL (Y) | 4.5 m |
| AF/OD | 151 mm |

| Repair Data | |
|---|---|
| Type of Concrete | Sika Deep Pour |
| Concrete 28d Strength | 60 MPa |
| Reinforcing type | Straight Rebar Type 2 |
| Reinforcing diameter | 8/N10 |
| Stud Diameter | M12 |
| No of Shear Studs | 4 |
| iNjectaPole extent above GL | 200 mm |

*Concrete pour 200mm above GL

| iNjectaPole Ratings | |
|---|---|
| BM Capacity | 10.5 kNm |
| Connection Shear Capacity | 2.4 kN |

Figure 7

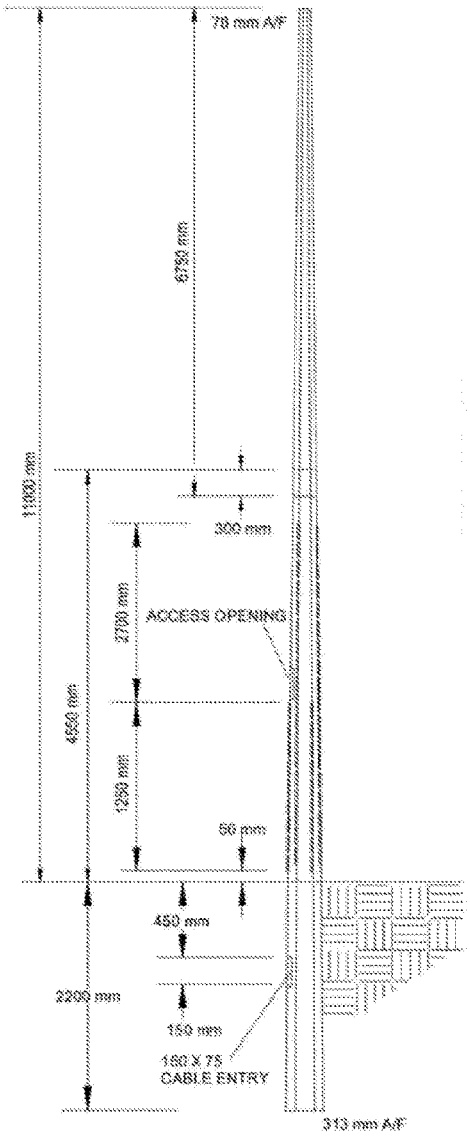

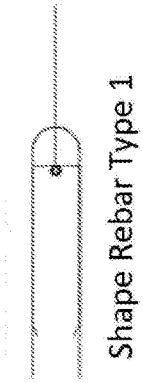

| Pole Data | |
|---|---|
| Pole Stock Code | CW0376 (12.5m) |
| Material Strength | 350 MPa |
| Pole Length | 13.2 m |
| New/Old | NEW - Cut at GL |
| Length above GL | 11 m |
| Length below GL | 2.2 m |
| Pole Wall Thickness | 8 mm |
| Length to Load from GL (Y) | 9 m |
| Horizontal Length to Load from GL (X) | 38 m |
| Angle | 20.06 deg |
| AF/OD | 274 mm |

| Concrete/Grout Data | |
|---|---|
| Type of Concrete | Sika Deep Pour |
| Concrete 28d Strength | 60 MPa |
| Reinforcing type | Shaped Rebar Type 1 |
| Reinforcing diameter | 88N10 |
| Stud type | Gr 4.6 - 75mm |
| Stud Diameter | M12 |
| No of Studs around pole | 8 |
| iRejectaPole extent above GL | 200 mm |

*Concrete pour 200mm above GL

| iRejectaPole Concrete Rating | |
|---|---|
| Bending Moment Capacity | 96 kNm |
| Connection Shear Capacity | 4.8 kN |

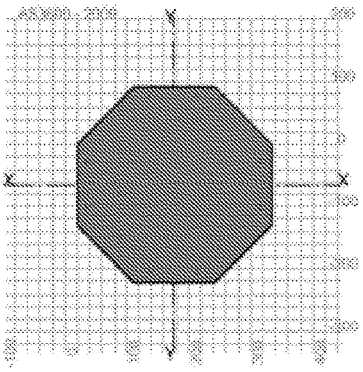

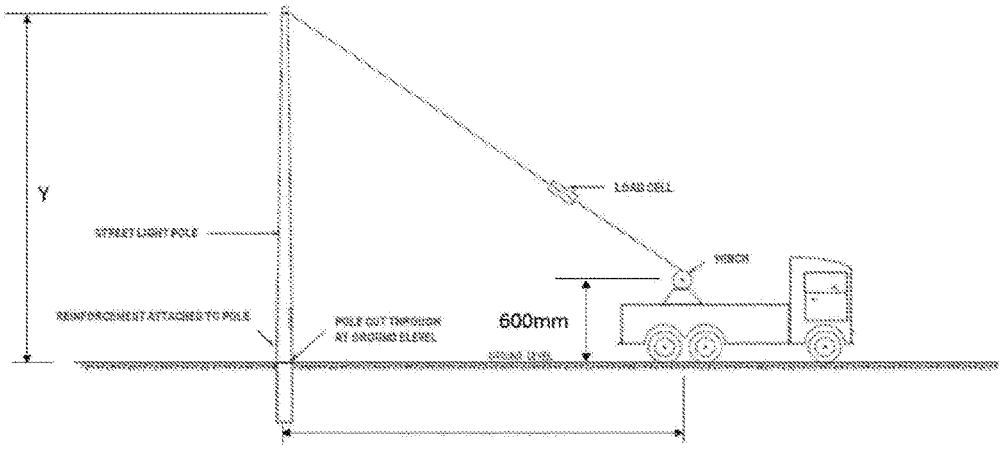

Figure 8

| Fatigue Loading Testing (P=140 kN) | | | | | |
|---|---|---|---|---|---|
| Sequence | Number of Cycles | Applied frequency (Hz) | Loading period (Seconds) | Load Applied (Tension) (kN) | Slotted Gap Opening (mm) |
| A | 4500 | 5 | 900 | 0 to 63 | 1.4 |
| B | 600 | 3 | 200 | 0 to 84 | 1.5 |
| C | 80 | 2 | 40 | 0 to 112 | 1.5 |
| D | 1 | 1 | 1 | 140 | 1.5 |
| E | 80 | 2 | 40 | 0 to 112 | 1.5 |
| F | 600 | 3 | 200 | 0 to 84 | 1.5 |
| G | 4500 | 5 | 900 | 0 to 63 | 1.5 |

Figure 9

| | | | | | |
|---|---|---|---|---|---|
| | | CW0255 | CW0255 | CW0275 | CW0276 |
| | | Non frangible version<br>Poured to hatch height<br>8N10 Rebars<br>No shear dowels | Frangible version<br>Poured to +200mm AG.<br>16M10 Rebars<br>Shear dowels 4M12 | Frangible version<br>Poured to +200mm AG.<br>16M10 Rebars<br>Shear dowels 6M12 | Frangible version<br>Poured to +200mm AG.<br>8X2N10 Rebars<br>Shear dowels 8M16 |
| Reinforcement extent above groundline | mm | 1000 | 200 | 200 | 200 |
| Reinforcement dowel arrangement | No/Size | Nil | 8M16 / 60 | 8x2 M16 / 90 | 8x2 M16 / 90 |
| Reinforcement reinforcing arrangement (* - U shaped bar) | No/Size | 8N12 Straight | 4x2N10* | 8x2N10* | 8x2N10* |
| Reinforcement Groundline Bending Moment Rating | kNm | 15 | 10 | 36 | 40 |

PLANTED POLE REINFORCEMENT METHODS

TECHNICAL FIELD

The present invention relates to methods for reinforcing hollow planted poles and in particular, hollow planted utility poles of metal.

BACKGROUND ART

In cities around the world, there has been a growing interest in replacing aging timber electric utility distribution poles and light poles with steel poles. Using galvanized steel utility poles is regarded as having several significant environmental benefits over timber including lower levels of greenhouse gas and aerosol emissions associated with global climate change; a lower burden on critical energy resources; reduced impacts on the habitats of many threatened and endangered species; and reduced impacts associated with hazardous emissions and wastes.

Steel utility poles are also regarded as having a number of other clear advantages over competing materials, for example, treated wood and concrete, including: ease of installation, fabrication with uniform dimensions, reliability, durability, impervious to insects and rot, free of toxic chemical treatments or hazardous waste concerns, completely recyclable, and a lower life cycle cost. It is estimated that there are approximately 185 million utility poles in North America alone and an estimated 2.5 million timber poles are replaced each year.

Unfortunately, planted utility poles of metal commonly experience groundline damage and loss of groundline strength as a result of contact with soils, moisture and oxygen. The walls of these hollow or at least partially hollow poles are typically thin and even if galvanized, the severity of the environmental conditions ultimately determines the lifespan of steel structures. Table 1 below shows atmospheric corrosivity categories and approximate life cycles to first maintenance (in years) for galvanized planted streetlight poles according to Australian Standards. The groundline zone of the pole also coincides with the highest bending moment of the structure and consequently the highest areas of stress. Any significant loss in strength capacity can result in the failure of the structure.

TABLE 1

System Designation HDG500 Life to First Maintenance to A52312

| | Atmospheric corrosivity category | | | | | | |
|---|---|---|---|---|---|---|---|
| | A Very low | B Low | C Medium | D High | E-I Very High Industrial | E-M Very High Marine | F Inland Tropical |
| LFM | 25+ | 25+ | 25+ | 10-25 | NR | 5-10 | 25+ |

Current methods for addressing groundline damage to planted utility poles include welding, bolting or strapping the pole to increase strength in the region of the groundline.

An aim of the present invention was to overcome substantially, or at least provide a useful alternative to, the above-mentioned problems associated with the prior art.

The preceding discussion of the background art is intended to facilitate an understanding of the present invention only. It should be appreciated that the discussion is not an acknowledgement or admission that any of the material referred to was part of the common general knowledge as at the priority date of the application.

SUMMARY OF INVENTION

In accordance with the present invention, there is provided a method for the reinforcement of a hollow planted pole, the method comprising the step of:

delivering a flowable composition into the hollow of a planted pole, the flowable composition being capable of setting in the hollow at least proximate to the groundline of the planted pole to form a substantially non-flowable composition when set;

wherein, the substantially non-flowable composition provides additional support for the planted pole at least proximate to the groundline.

In a preferred embodiment of the method of the invention, one or more reinforcement supports are at least partially embedded in the set substantially non-flowable composition. Preferably, most or all of the one or more reinforcement supports are completely embedded in the set substantially non-flowable composition. The one or more reinforcement supports can be at least partially embedded into the substantially non-flowable composition by emplacing (i.e. positioning) the one or more reinforcement supports in the flowable composition in the hollow prior to the setting of the composition. Alternatively, the one or more reinforcement supports can be at least partially embedded in the substantially non-flowable composition by emplacing the one or more reinforcement supports in the hollow prior to the step of delivering the flowable composition into the hollow.

The one or more reinforcement supports preferably comprise steel bars. For the purposes of describing the invention, "steel bars" also refers to metal and metal alloy bars. More preferably, the one or more reinforcement supports preferably comprise steel reinforcing bars ("rebars"); and/or steel fibres, pieces of metal or metal objects. The reinforcement supports preferably comprise a diameter of between approximately 6 mm and 36 mm. More preferably, the reinforcement supports comprise a diameter of approximately 10 mm and/or 12 mm. The reinforcement supports preferably comprise 500 MPa steel reinforcing bars. The reinforcement supports may comprise substantially straight steel reinforcing bars. Alternatively, the reinforcement supports may comprise a variety of different shapes that can fit within the hollow of the planted pole to be reinforced, and preferably can be inserted through the access hole as one piece, or in parts which are then reattached to complete the shape within the hollow. In a preferred embodiment of the method of the invention, the reinforcement supports are forked comprising at least two prongs emanating from a single stem. A benefit of multiple prongs is the provision of additional strength to the reinforcement of a hollow planted pole according to the method of the invention. The diameter of the prongs and stem of the forked reinforcing bar(s) may be the same or different.

In a preferred embodiment, the reinforcement supports are positioned at approximately regular intervals adjacent to the internal wall of the hollow of the planted pole and at least proximate to the groundline. For the purposes of describing the invention, "proximate to the groundline" refers to the area of the hollow of a planted pole above the groundline (but below the wire access hole), below the groundline, and at the groundline (the "groundline" referring to the surface level of the ground around the planted pole). Preferably, the distance between the emplaced one or more reinforcement supports and the internal wall of the hollow is less than approximately 15 mm. More preferably, the distance between the emplaced one or more reinforcement supports and the internal wall of the hollow is approximately 10 mm. More preferably, the reinforcement supports are positioned substantially vertical and are maintained in position with one or more spacers. That is, one or more spacers preferably maintain the position of the one or more reinforcement supports in the hollow prior to the setting of the substantially non-flowable composition.

In a preferred embodiment, the one or more spacers comprise magnets or are magnetic. Preferably, the hollow planted pole comprises metal at least proximate to the groundline, the one or more reinforcement supports comprise metal, and the one or more spacers are magnetic and attach to the metal of the one or more reinforcement supports and to the metal of the internal wall of the hollow. The spacers can therefore be attached to the metal of the planted pole and the metal of the reinforcement supports, therein holding the reinforcement supports adjacent to the interior wall of the metal planted pole. More preferably, the spacers comprise a magnetic ring, for example, a washer, having a hole through which at least a portion of a reinforcement support can be inserted and the magnetic force will maintain the magnetic ring around the reinforcement support in the position it is placed. For a forked reinforcement support, one or more magnetic spacer may be placed on each prong and/or on the stem.

In an alternative embodiment, the one or more spacers preferably comprise blocks attached to the internal wall of the hollow of the planted pole which can hold reinforcement supports in position. In one, non-limiting example, the blocks are foam blocks or comprise foam. In another example, clips attach to the internal wall of the hollow which can hold reinforcing bars in position.

In a preferred embodiment of the method of the invention, the flowable composition comprises concrete and/or grout. Preferably, the flowable composition is a high strength concrete, and a low shrinkage concrete. More preferably, the flowable composition has a high strength of at least 50 MPa, and the flowable composition has an early strength of 24 hours of less. The concrete and/or grout may be prepared using methods known in the art. The flowable composition may comprise aggregates. The flowable composition may also comprise additives including, in one non-limiting example, corrosion inhibitors. In a preferred embodiment of the invention, the flowable composition is poured in one section and comprises a high strength, low shrinkage, structural grout. In an alternative embodiment, the flowable composition is poured in two sections comprising:

- a first bottom pour of concrete and/or grout into the hollow;
- and a second upper pour of concrete and/or grout into the hollow on to the first bottom pour.

Preferably, the second upper pour is a higher specification concrete and/or grout than the first bottom pour. More preferably, the second upper pour is a low shrinkage concrete and/or grout.

Access to the hollow of the planted pole is necessary to carry out the method of the invention. Hollow utility poles including metal light poles and metal power distribution poles commonly comprise a wire access hole which is accessible by a, usually lockable, access door in the wall of the pole. The primary purpose of this access hole is for accessing wiring and fuses contained within the hollow of the planted pole which connect the light(s) at the top of the pole to a power supply. However, for carrying out the method of the invention, this access hole is the preferred means for accessing the hollow of the planted pole. If the method of the invention needs to be performed on a planted pole that does not have such an access hole, the hollow may be accessed by creating a access hole in the side of the planted pole by means and methods known in the art.

The composition is delivered through a hole, and preferably an access hole, in the side of the planted pole to be reinforced. Delivery of the flowable composition may be through use of a variety of different means and methods known in the art. In a preferred method, the flowable composition is pumped through a hose which is directed into the hollow through the access hole. The flowable composition is preferably pumped through the hose into the hollow of the planted pole at a slow rate so as to avoid the formation of air pockets in the composition. The flowable composition pumped into the hollow fills the base of the planted pole below the ground line and preferably up to a pre-determined height above the groundline which reinforces the planted pole in the region potentially most affected by, for example, corrosion for metal poles, or damage to other types of hollow planted poles. Preferably, the composition fills the hollow in the base of the planted pole to a minimum height of approximately 200 mm above the groundline. The height the composition fills the hollow in the base of the planted pole above the groundline may depend on road safety or other regulations. For example, maximum heights for reinforcement above the groundline may be specified by local authorities to prevent worse outcomes for a vehicle impacting a pole. Therefore, in a preferred embodiment, the composition fills the hollow in the base of the planted pole to a height of approximately 200 mm above the groundline.

In a preferred embodiment, the method of the invention comprises the step of covering wiring and any other electrical equipment, for example, fuses, in the hollow of the planted pole prior to delivering the flowable composition into the hollow. Preferably, covering the wiring in the hollow prevents the composition from contacting the wiring when the composition is delivered into the hollow of the planted pole. The wiring may be covered by materials known in the art for covering and protecting electrical wires. In one non-limiting example, the wires are covered with a conduit sleeve comprising plastic. The conduit sleeve may be insulated.

In a preferred embodiment, the method of the present invention comprises the step of attaching the substantially non-flowable composition to the hollow planted pole. One or more attachment means are preferably used to attach the substantially non-flowable composition to the planted pole. The attachment means may comprise in some non-limiting examples, studs, screws, pins, or bolts. Such attachment means will include those known in the art for attaching, for example, concrete and metal. Preferably the attachment means comprise one or more studs. More preferably, the attachment means comprises one or more shear connectors or shear studs. One or more attachment means are preferably inserted or drilled through the wall of the planted pole and into the composition within the hollow of the pole, preferably above the groundline. The one or more attachment means can be inserted or drilled through the wall of the planted pole and into the composition either before or after the composition has set. One or more attachment means may also be inserted or drilled through the wall of the planted pole before the composition has been delivered into the hollow.

For non-circular planted poles having multiple sides, attachment means are preferably inserted or drilled through the wall of the planted pole into at least one side. More preferably, attachment means are inserted or drilled into the exterior surface of each side of the wall of a non-circular planted pole. Two or more attachment means inserted or drilled into the wall of the planted pole, whether round, or having multiple sides, may be at the same height of the planted pole or at different heights. There may also be more than one 'row' of two or more attachment means inserted or drilled into the wall of the planted pole at the same height. Multiple attachment means and multiple 'rows' of attachment means will provide an advantage of greater attachment strength between the planted pole and set substantially non-flowable composition, particularly for larger planted poles of metal.

Prior to reinforcing a hollow planted pole according to a method of the invention, the hollow is preferably cleaned before the flowable composition is delivered. Thus, the method of the invention preferably includes a prior step of cleaning the hollow of a planted pole in the vicinity of the base, for example, between the access hole and the base of the pole. More preferably, the hollow is cleaned with compressed air or water. Cleaning with water has the added benefit of assisting to cure concrete or grout, and the wetting of the soil at the base of the pole prevents excessive extraction of moisture from wet concrete or grout.

The method of the invention may be used for the reinforcement of a hollow planted pole constructed from metal or comprising metal. The metal planted pole may be galvanized. The method of the invention is more preferably for the reinforcement of a hollow planted pole constructed from metal or comprising metal, wherein the hollow planted pole of metal is affected by corrosion or is at risk of corrosion at least proximate to the groundline, adjacent to access holes, for example wire access holes above and below the groundline, and/or adjacent to the base of the pole.

The method of the invention is preferably carried out on a hollow planted pole for the benefit that the pole can be reinforced without removing it from the ground. However, the method of the invention could also be carried out on a pole that is not planted in the ground, for example, because it has been removed from the ground for repair, or has not yet been planted in the ground, wherein the base will need to be covered to prevent loss of flowable composition before it has set.

The method of the invention assists the reinstatement of the groundline strength capacity of a hollow planted pole and ultimately offers a life extension to the pole at a fraction of the cost of repair without compromising the aesthetic features of the structure.

Modifications and variations such as would be apparent to a skilled addressee are deemed to be within the scope of the present invention.

BRIEF DESCRIPTION OF DRAWINGS

The present invention will now be described, by way of example only, with reference to an embodiment thereof, and the accompanying drawing, in which:—

FIG. 5 shows the pole and test details for the horizontal tests conducted on the CW0255 (6.5 m) pole.

FIG. 7 shows the pole and test details for the horizontal tests conducted on the CW0276 (12.5 m) pole.

FIG. 8 shows a table setting out the associated load cycles and loads as prescribed by Western Power® Corporation for fatigue testing on CW0275 & CW0276 poles.

FIG. 9 shows a table providing some specific parameters and groundline bending moment ratings when the street light pole repair system was used on three octagonal sectional poles, the CW0255 (6.5 m), CW0275 (10.5 m) and the CW0276 (12.5 m).

DESCRIPTION OF PREFERRED EMBODIMENTS

Figure 1:
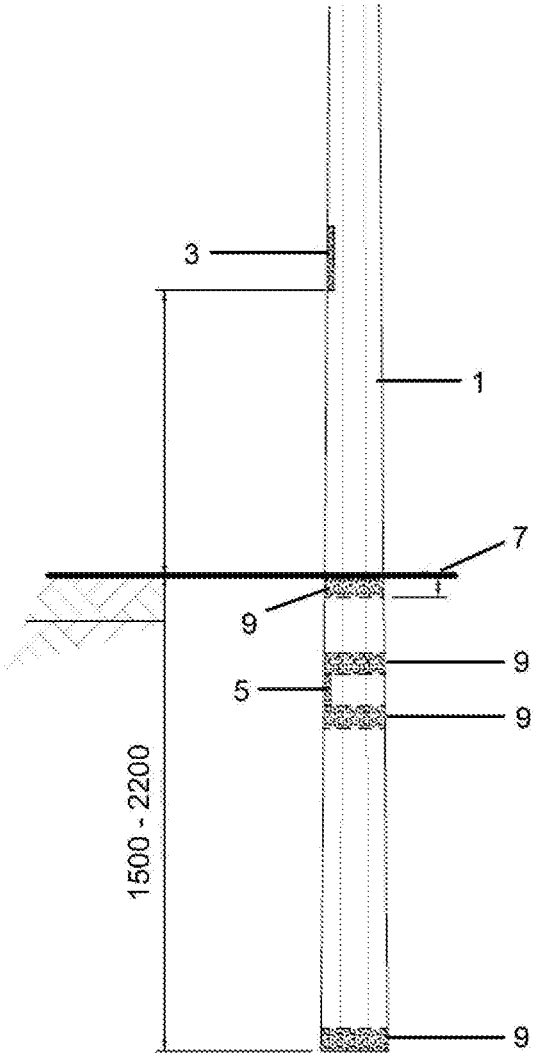
FIG. 1 shows an illustration of a longitudinal cross section through the bottom portion of an octagonal hollow planted pole.

Those skilled in the art will appreciate that the invention described herein is susceptible to variations and modifications other than those specifically described. The invention includes all such variation and modifications. The present invention is also not to be limited in scope by any of the specific embodiments described herein. These embodiments are intended for the purpose of exemplification and illustration only. Functionally equivalent apparatus and methods are clearly within the scope of the invention as described herein. The invention also includes all of the features and/or steps referred to or indicated in the specification, individually or collectively and any and all combinations or any two or more of the features and/or steps.

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness. None of the cited material or the information contained in that material should, however be understood to be common general knowledge.

Manufacturer's instructions, descriptions, product specifications, and product sheets for any products mentioned herein or in any document incorporated by reference herein, are hereby incorporated herein by reference, and may be employed in the practice of the invention.

The invention described herein may include one or more range of values (e.g. size, length, weight, etc.). A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all other technical terms used herein have the same meaning as commonly understood to one of ordinary skill in the art to which the invention belongs.

Reference numbers and letters appearing between parentheses in the claims, identifying features described in the embodiment(s) and/or example(s) and/or illustrated in the accompanying drawings, are provided as an aid to the reader as an exemplification of the matter claimed. The inclusion of such reference numbers and letters is not to be interpreted as placing any limitations on the scope of the claims.

The following embodiments serve to more fully describe the manner of using the above-described invention, as well as to set forth the best modes contemplated for carrying out various aspects of the invention. It is understood that these embodiments in no way serve to limit the true scope of this invention, but rather are presented for illustrative purposes.

A hollow, galvanized metal, octagonal planted streetlight pole requiring reinforcement according to a method of the invention is shown in FIG. 1. The pole 1 has an access door 3 at a height that varies depending on the specific model of planted utility pole 1 produced by different manufacturers. Also dependent of the model of the pole 1 is the height of the buried portion of the pole 1 which can vary as much as between 1500 mm and 2200 mm. A cable entry 5 below the groundline 7 provides access for the electrical wiring to enter the hollow of the pole 1. Corrosion zones 9 typically occur just below the groundline 7, adjacent to the cable entry 5, and at the base of the pole 1 where higher levels of moisture as well as oxygen provide ideal conditions for corrosion.

According to a first preferred embodiment of the planted pole reinforcement method of the invention, in a first step shown in FIG. 2A, the access door 3 of the planted pole 1 was unlocked and opened making the hollow of the pole accessible through the access hole 4. The dimensions of the access hole 4 were approximately 300 mm×100 mm and the access hole 4 was situated approximately 1300 mm from the groundline 7.

The hollow of the pole 1 adjacent to the access door 3, and below the groundline 7 was checked with a torch for blockages, levels of corrosion damage on the interior wall of the hollow, snakes, spiders, or anything else which may affect how the method of the invention is carried out.

The same area of the hollow of the pole 1 was then cleaned using water to remove, for example, dust, spiders and their webs, from the interior wall of the hollow. The water also assists with the curing of the composition and minimises absorption of water from the wet flowable composition by the soil at the base of the pole 1. Compressed air was also used to clean the streetlight cables 11 within the hollow of the pole 1 which contain the wiring for the streetlight at the top of the pole 1. These cables 11 enter the hollow through the subsurface cable entry 5 aperture below the groundline 7 and run up through the hollow of the pole 1.

A plastic conduit sleeve 13 was then placed around the streetlight cables 11, the conduit sleeve 13 encasing the streetlight cables 11 from about the subsurface cable entry 5 aperture to a point just above a position 200 mm above the groundline 7 (FIG. 2A).

Figure 2:
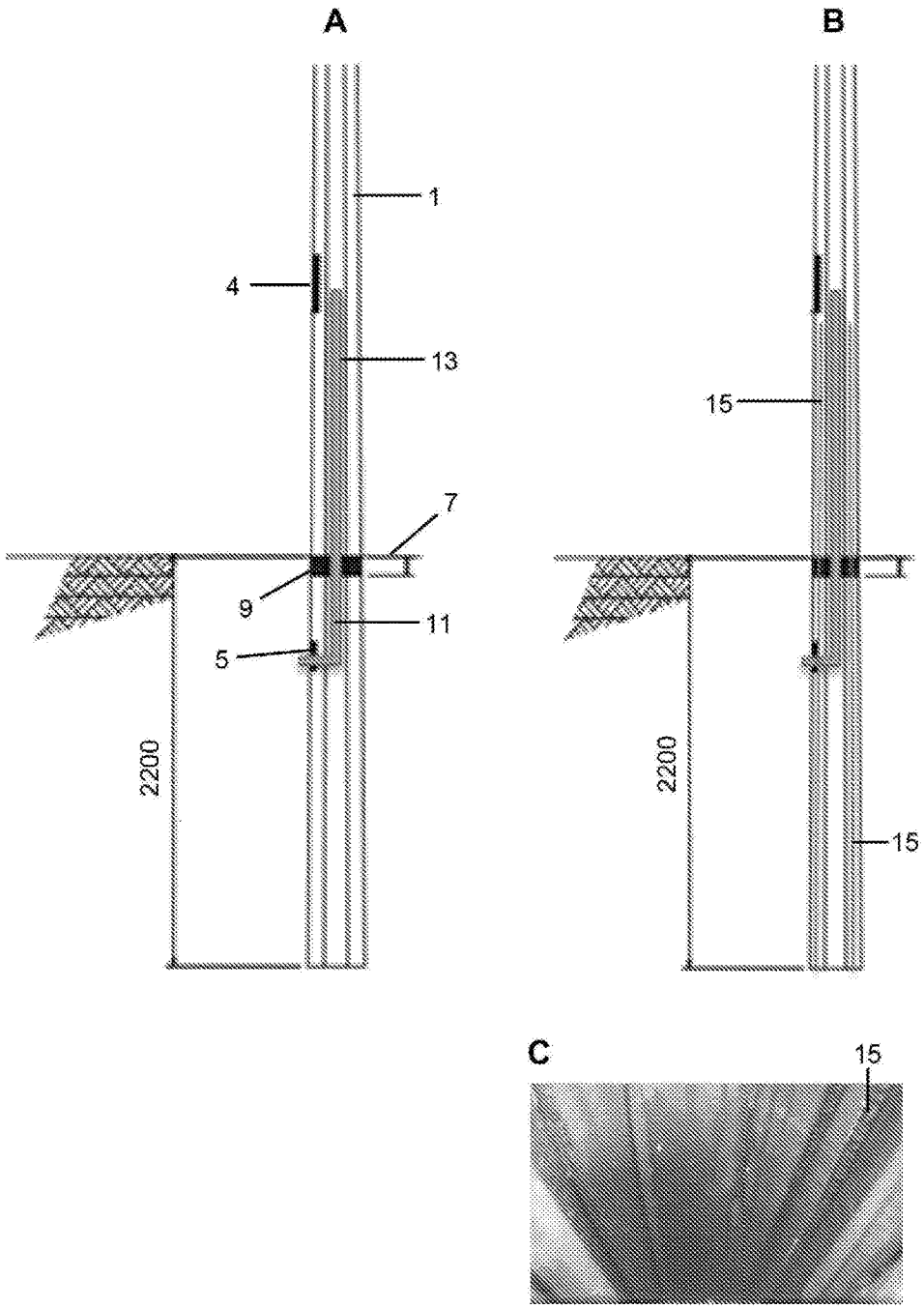
FIG. 2 shows an illustration of a longitudinal cross section through the bottom portion of an octagonal hollow planted pole (A) after conduit has been placed over the electrical cables of the planted pole, (B) after rebars have been inserted through the access hole and placed at each corner of the octagonal hollow; (C) is a photograph of the hollow of a planted pole after placement of rebars.

The planted streetlight pole 1 in FIG. 2 is a substantially octagonal pole having eight surfaces and eight corners on the exterior of the pole as well as in the hollow as shown in the longitudinal cross section of the planted pole 1. In the next step, eight galvanized reinforcement bars ("rebars" 15) of 12 mm diameter (N12) were passed through the access hole 4 and positioned vertically in the hollow in each of the eight corners of the octagonal-shaped hollow. Each of the eight rebars 15 were held vertically and in place in each of the eight corners by rebar column spacers which were stuck to the interior wall of the hollow using glue on spots. The rebar column spacers hold the rebars substantially vertically and parallel to each other, and at a distance of approximately 10 mm to 15 mm from the interior wall of the hollow of the pole 1 (FIG. 2B and in the photograph of FIG. 2C). The rebars 15 were of a length that when positioned vertically, almost touched the base of the pole 1 but did not extend vertically more than about 200 mm above the groundline 7.

In the following step shown in FIG. 3A and in the photograph in FIG. 3B, a shear stud 17 (50-100 mm long galvanized metal bolt) was drilled through each octagonal face of the pole 1 approximately 200 mm above the groundline 7, the eight shear studs 17 extending into the hollow.

Figure 3:
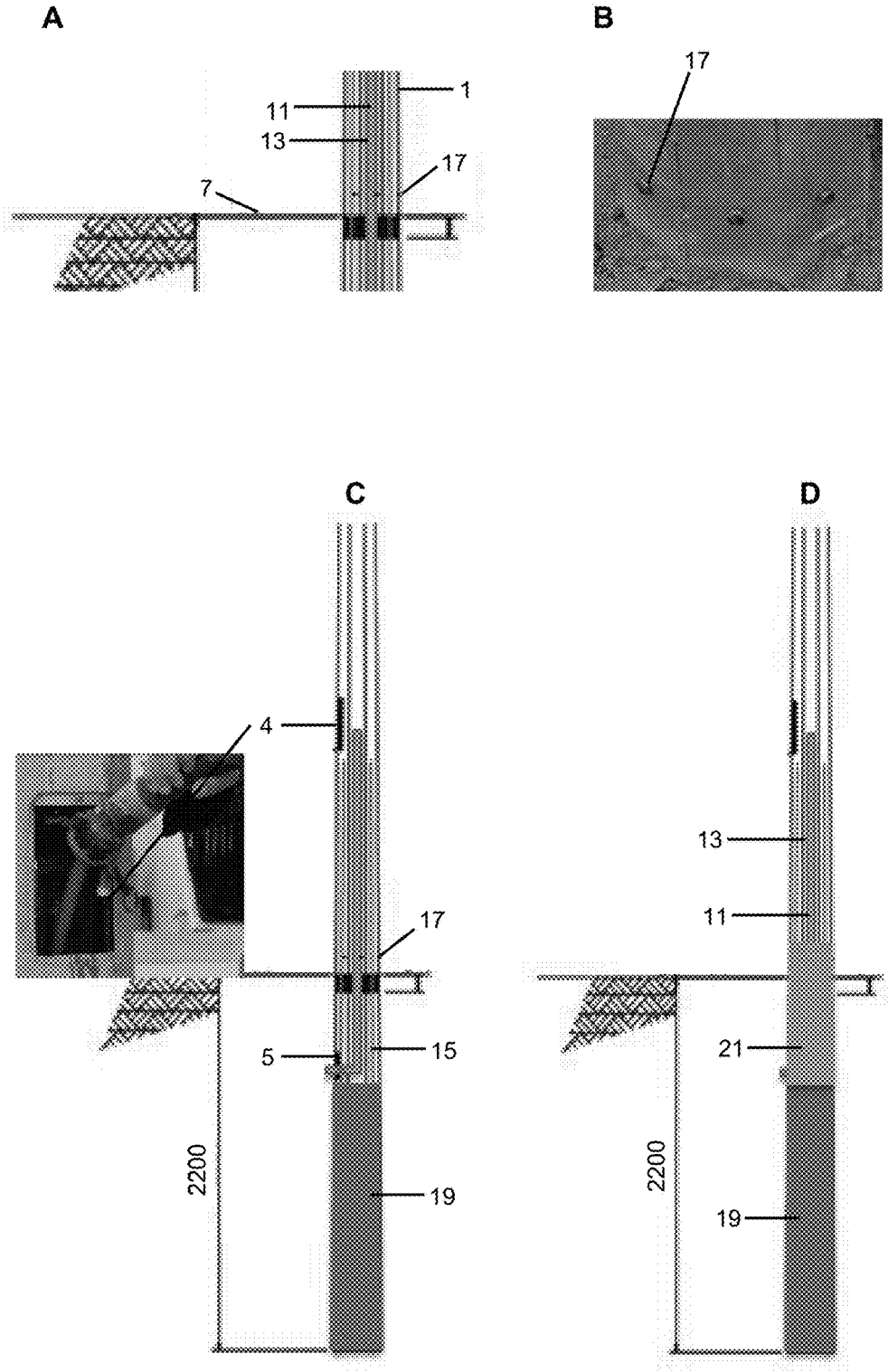
FIG. 3 shows an illustration of a longitudinal cross section through the bottom portion of an octagonal hollow planted pole (A) after drilling and placing shear studs into each side of the pole ((B) is a photograph of a planted pole containing the studs), (C) after a 'bottom pour' of low specification, high strength concrete/grout into the base of the hollow planted pole (including photograph of concrete being poured through the access hole into the base of the hollow planted pole); and (D) after an upper pour of high specification, low shrinkage high strength concrete/grout into the hollow planted pole above the bottom pour.

Next, low specification concrete/grout (flowable grout with fine aggregate) was mixed and then pumped through the access hole 4 and into the hollow until this 'bottom pour' 19 filled the hollow from the base of the pole 1 to a maximum of approximately 1 m below the groundline 7, and covered the rebars 15 to a height just below the subsurface cable entry 5 aperture (FIG. 3C). A second 'upper pour' 21 of higher specification, low shrinkage concrete/grout (Sika-Grout®-Deep Pour) was then poured on top of the 'bottom' pour' 19 and covered the rebars 15 and shear studs 17 to a height of about 200 mm above the groundline 7 (FIG. 3D) and extended no lower than approximately 1 m below the groundline 7. The plastic conduit sleeve 13 encasing the streetlight cables 11 extended above the top of the upper pour 21 concrete/grout in the hollow. The concrete/grout set within approximately 24 hours, at which point the planted streetlight pole was reinforced and protected near the groundline from structural failure and collapsing as a result of corrosion or other damage to the metal pole.

In another embodiment, metal fibres may be added and mixed through the concrete and/or grout mix prior to delivery to the hollow of a planted pole to provide additional strength to the concrete/grout when set.

The present invention also provides a structural repair kit for reinforcing a metal planted utility pole. The structural repair kit comprises at least a vehicle with a mounted apparatus for grasping and holding planted utility poles; a concrete grout mixer and an apparatus for pumping the concrete; an electricity generator; a water tank; galvanized rebars; rebar spacers; aggregate; cement/grout; and flexible conduits. The structural repair kit can be used in the reinforcement of a hollow planted pole.

Figure 4:
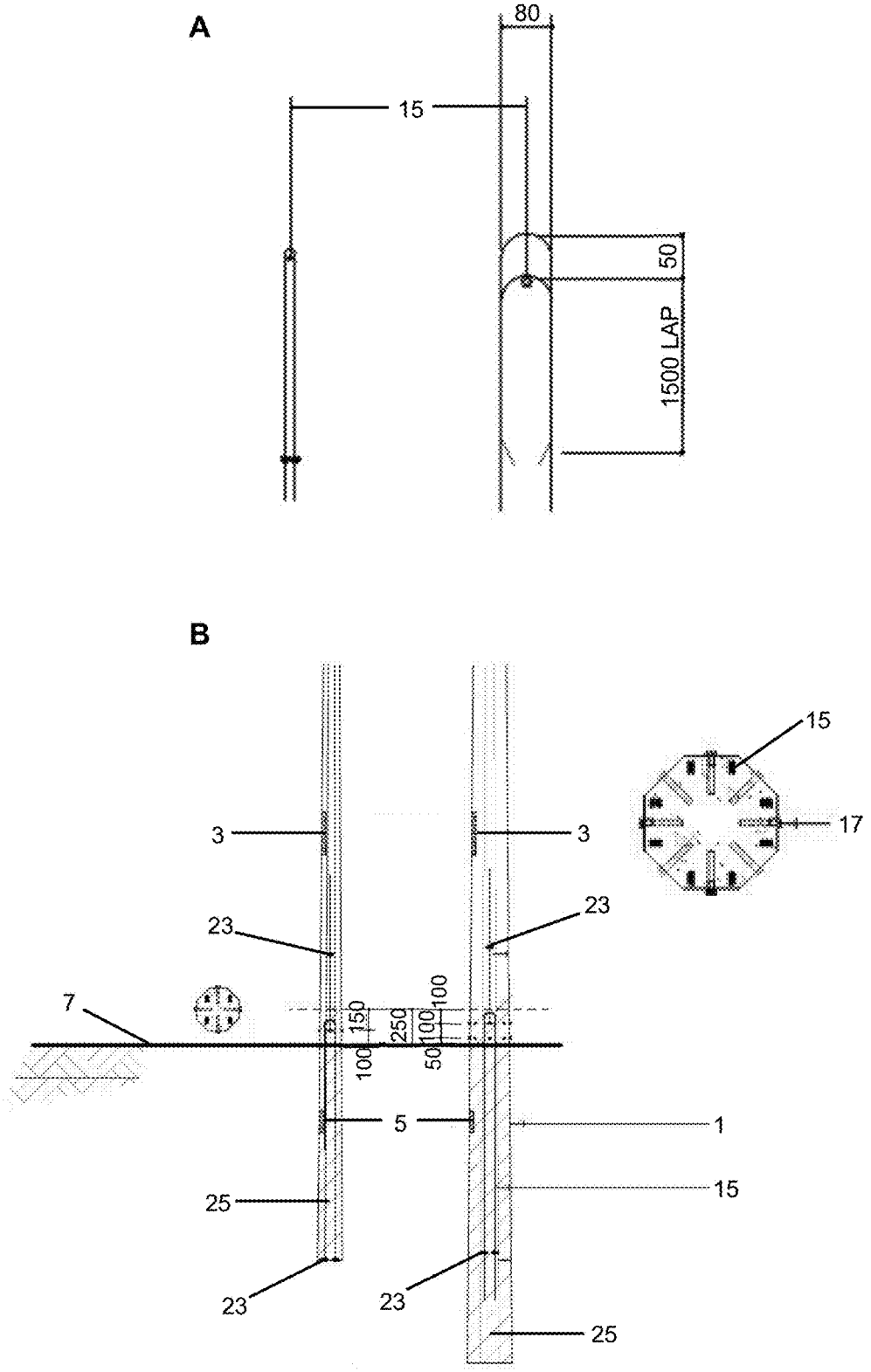
FIG. 4 shows an illustration of (A) two versions of forked rebars for use in the method of the invention according to the second preferred embodiment; and (B) a longitudinal cross section through the bottom portion of two different octagonal hollow planted poles that have been reinforced using the method of the invention according to the second preferred embodiment.

In a second preferred embodiment of the planted pole reinforcement method of the invention, a first key difference to the method according to the first embodiment is that the rebars 15 are forked as shown in FIG. 4A and shown placed within the hollow in FIG. 4B. The rebar on the left in FIG. 4A has a 10 mm diameter and is preferred for use in a smaller, for example, 6.5 m pole, and the rebar on the right has a 12 mm diameter and is preferred for use in larger 10.5 m and 12.5 m poles (measurements in mm).

In the second preferred embodiment, a second key difference to the method according to the first embodiment is that the spacers comprise magnetic rings which the prongs or the stem of the forked rebar are threaded through. As shown in FIG. 4B in each of the metal planted poles 1, the magnetic spacers 23 are positioned near the bottom of the prongs of the rebar 15 and around the middle of the stem of the rebar 15. Cross sections through the octagonal poles 1 show the shear studs 17 extending into the hollow and cross sections through the prongs of the forked rebar 15. In the pole 1 on the left in FIG. 4B there is only one 'row' of eight shear studs 17 in each face of the octagonal pole 1, while there is two 'rows' of eight shear studs 17 in each face of the larger octagonal pole 1 on the right. The fork in the rebar 15 is placed just above the row or rows of shear studs 17 so that the prongs of the forked rebar 15 will be set in the concrete/grout composition.

In the second preferred embodiment, a third key difference to the method according to the first embodiment is that there is no 'bottom pour' of low specification concrete/grout. Instead higher specification, low shrinkage concrete/grout 25 (SikaGrout®-Deep Pour) (i.e. the 'upper pour' in the method according to the first embodiment) is the only flowable composition used and is poured into the base of the pole up to approximately 200 mm above the groundline (shown as cross-hatching in FIG. 4B).

An example 'operator's manual' describing use of the method of the invention according to the second preferred embodiment on street light poles, as well as results of tests which were conducted on street light poles reinforced using these methods is provided in the Example as follows.

Example—Reinforcement of Street Light Planted Poles

Introduction

The street light pole repair system is a professional structural engineer designed solution (CPEng, RPEQ) that can be certified. It provides a life extension to a pole for as long as the pole remains durable above the repair level (i.e. 200 mm above groundline).

It is a common misconception that steel poles are only affected by corrosion at the groundline zone. Due to the fact that these poles are hollow, corrosion will also originate from the base upwards and from the access aperture below ground. It is therefore imperative that the full extent of the planted foundation section of the pole be remedied.

Street light poles are commonly designed as frangible structures for vehicular safety considerations, while maintaining the functional integrity of supporting their associated attachments, brackets and luminaries in the prevailing loading conditions. The street light pole repair system has been designed to minimise any effect on the frangibility of the pole which remain as originally designed. It can also provide improved foundation stability to a pole that attracts additional wind loading from marketing banners, brackets or luminaries. Moreover, the street light pole repair system has no discernible effect on the aesthetics of the pole. Treatment is from the inside and the only visible sign of change would be the shear studs evident around the pole at ground line. However, this provides a benefit for ease of identification of an already repaired pole.

While the street light pole repair system can be used to reinforce a hollow planted pole of metal such as steel, it may also be used on a pole comprising other material types including aluminium, fibreglass and plastic.

In the street light pole repair system, a reinforced concrete column is designed to match the cross sectional profile of the existing pole. Any shape is possible (octagonal, hexagonal, circular, SHS, RHS, etc.). The design accounts for adequate reinforcing to match or exceed the loading requirements for the original pole and complies with the local standards and laws (e.g. Australian Standards).

The concrete that is employed in the street light pole repair system should assume specific characteristics that allow it to be injected into the confines of the pole (flowable), gain rapid early strength, be self-levelling and not shrink or crack excessively during the process of curing. By definition, such concrete is classified as a structural grout and a preferred product in this regard would be SikaGrout®-Deep Pour structural grout.

The reinforcement support is standard rebar, for example, supplied by One Steel® and while N10 bars generally meet structural requirements, N12 bars may also be used because of stiffness during installation which assists with alignment and accurate concrete cover. The final rebar specification is selected based on practical considerations dependant on whether the solution is frangible or not. The non-frangible solution employs N12 straight bars while the frangible version requires shaped (bent ligature) rebar and as such the preference is for N10 rebar but bundled. The reinforcement support designs should be certified by registered structural engineers.

The lifespan of the repair using the street light pole repair system is preferably in excess of 50 years and the extension to the residual life of the pole is therefore a function of the durability of the remaining pole above the area of treatment.

The reinforcement of a planted pole using the street light pole repair system can be implemented as high up the pole as required although the frangibility would likely be compromised. In situations where frangibility is a requirement the new concrete column only project approximately 200 mm above groundline. To cater for this loss in transfer length (load transfer between concrete & pole) shear dowels/studs are introduced to the profile to ensure composite action.

Materials and Methods

Reinforcement System Components and Material Properties

A high strength concrete/structural grout is injected into the pole. Treatment starts from the base of the pole (ranging from 1500 mm to 2200 mm below groundline) and extends up to the adopted frangibility level which is recommended at 200 mm above groundline.

The zone of 200 mm above groundline to approximately 800 mm below groundline is considered the critical zone due to this being the zone of highest bending stress in the pole (FIG. 5). However, the concrete below this zone does form a critical component of the repair system. While the area below this zone is less critical structurally, this lower zone of concrete addresses subsurface corrosion issues by removing oxygen and as such should remain a monolithic concrete pour with the solution. Efforts have been made to reduce costs by splitting these grades of concrete but concerns over quality control suggest a consistent grade concrete be injected into the pole.

Concrete/Grout—SikaGrout®-Deep Pour Grout

High early strength 1 day 18+ MPa 3 days 30+ MPa 7 days 40+ MPa 28 days 60+ MPa

Shrinkage compensating properties

Flowable

Lab tested to Australian Standards 1478.2

Reinforcement Bars—generally 8×N10 or N12 reinforcement bars (for example, supplied by One Steel®) are introduced into the pole. Rebars may be galvanized for durability reasons although this may be considered conservative.

Shear Dowels/Studs—M12/16 Shear Studs—60-100 mm long grade 4.6 galvanized bolts as shear studs. These facilitate shear transfer between the existing pipe shell and new concrete ensuring composite action and load transfer.

Reinforcing Cover Spacers—Magnetic Ferrite Rings/Bars are employed to space the rebar away from the internal wall of the pole. Cover to reinforcing ensures encapsulation by concrete thereby improving durability.

General Workflow—Streetlight Pole Reinforcement

The pole is isolated before any work commences. Supply power to pole is to be disconnected or isolated and proved de-energised at the street light cut-out prior to any work on the pole.

A touch potential check is performed (SWMS—Stray Voltage Test)

The pole condition is evaluated.

The pole is held using a vehicle mounted pole grab (for example, Kevrek® or similar) for the duration of the repair. Should the streetlight pole happen to break off at the rusted groundline during the reinforcement installation, the pole will be laid on its side, fenced off and made safe for members of the public. The electrical connections made safe by means of installing a temporarily mini pillar. The pole will be reported to the power corporation responsible for the pole (Western Power® Corporation in Western Australia) for replacement.

The access door is opened and the inside of the pole is inspected.

Reinforcement bars ("rebar") are placed through the access hole, evenly around the interior wall of the hollow of the pole. During this process a minimum of 10 mm and maximum of 15 mm distance between the rebar and interior pole wall is achieved using ferrite magnets.

Shear Studs are drilled and secured equally around the perimeter of the pole. All drilling is performed using a penetration limiting bit and the internal electrical cable in the pole is protected with a cable sleeve during the drilling process.

In octagonal pole profiles the Shear Studs are positioned in the centre of the eight sides. At this time a single bleed hole (preferably 10 mm diameter) is also drilled into one of the frangible corners of the pole, approximately 200 mm above groundline, to serve as a concrete level indicator. It is important that this bleed hole is large enough to allow concrete flow without the need for head build-up.

For CW0275 & CW0276 pole profiles this Shear Stud arrangement consists of 2 rows of 8M16/90 mm long studs approximately 50/150 mm above groundline. For the CW0255 pole profile, a single row of 4M16/60 mm long Shear Studs are positioned 100 mm above groundline.

Inject SikaGrout®-Deep Pour High Strength Structural Grout using specialised grout pumps to about approximately 100 mm above the stud shear level. The discharge nozzle of the pump hose is to be lowered sufficiently below the cut-out to avoid concrete splash onto the cut-out.

Perform a Megger Test to check that the cable has not been damaged and/or connections disturbed during the works.

Re-connected the power supply and perform a full Metrel test to ensure that power has been restored correctly.

Perform a completion touch potential check (SWMS—Stray Voltage Test)

Close up access door and clean up.

Plant Equipment and Resources

A typical installation crew for carrying out the street light pole repair system will consist of two trained crew members. The senior member of the crew is preferably a qualified electrician and be proficient with concrete work.

An eight Ton flatbed truck with sufficient tray area to hold all plant and material and have sufficient working space can be used. The vehicle will also have side rails as guarding for working at heights as all mixing and pumping will be performed off the back of the vehicle. Other equipment includes Diesel/Hydraulic Drive Power Pack fitted with silencer, Electric or Diesel Grout Mixer and Injection Pump combination kit, and water containers for concrete/grout mixing and cleaning purposes.

Performance and Degradation

A pole reinforced by the street light pole repair system should provide a minimum 50 year design life. The repaired structural system will therefore have a residual life expectancy that is a direct function of the remaining life of the streetlight pole above the zone of repair. After repair, concerns for the corrosion of the steel in contact with soils (or buried) are negated by the new structural reinforced concrete core (a new 'heart'). This new concrete core is constructed from a very high quality reinforced concrete.

The added advantage of the system is that the new concrete core becomes protected by the redundant steel casing (old pole base) below ground which adds to its already durable characteristics. It is also the case that this concrete has removed all oxygen from the base of the pole thus eliminating the potential for further corrosion below ground. Residual life expectancy therefore becomes a direct function of the effects of atmospheric corrosion on the pole itself. The pole's new residual life is therefore a direct function of the environment and its effect on the durability of the streetlight pole above ground. The structural performance of the overall repaired system is in no way compromised. The serviceability and ultimate limit state performance is actually enhanced by increased gravity loads from the new concrete core, providing improved overall stability. This may be of particular advantage to poles where advertising or display banners are retro-introduced. This new core has no discernible effect on deflections and the frangibility of the pole for vehicular impact loads is in no way affected due to this repair level remaining below the impact level of a vehicle.

Additional Protection Layer (Finishing)

A protective coating may be added to the outside base of a pole repaired by the street light pole repair system, for example, for 0-300 mm above ground. This is aimed to provide splash and mechanical protection to the steel pole and its galvanizing. Such treatment is preferably restricted to above groundline to avoid foundation disturbance.

Internal Moisture Mitigation

The inside of a pole repaired by the street light pole repair system, could be prone to moisture ingress either due to rain penetration through the frangibility slits, or minor condensation (on the closed CW0255) due to temperature fluctuations.

There is a risk that such moisture "ponds" on the new concrete top could cause internal corrosion. Therefore, the perforated (frangible versions) can be ventilated to eliminate this risk. In the non-frangible version (CW0255) the extent of condensation is considered negligible (and no more than has always been present prior to reinforcement) and of little consequence.

Rebar Galvanizing

A further option is to galvanize the rebar due to the fact that the rebar "handle" will remain exposed within the pole and potentially attract moisture and ultimately corrode and then extend such corrosion into the concrete. However, these moisture levels are calculated to be low and this would have an extremely low likelihood of occurring.

However, galvanizing rebar is potentially beneficial if not hindered by cost. Alternatively the handle could be removed by employing an internally threaded attachment sleeve to the rebar assembly and employing a detachable threaded handle.

Durability of the Concrete Solution

The new concrete core is protected by the redundant steel casing (old pole base) below ground which adds to its already durable characteristics.

The street light pole repair system provides the following durability enhancement:

Chasing up the compressive strength of concrete improves its durability—60+ MPa is preferable for severe exposure classifications.

Increasing the cover to rebar improves durability although at a structural efficiency cost—for example, provide 20 mm cover (aggregate <5 mm) which is considered adequate for most situations. However, this situation could be revised should there be a requirement for increased durability. As an example in known very severe environments cover could be increased to say 25 mm with an increase in bar diameter.

Providing a liner (old pole) offers protection as is advised for severe to very severe conditions. This has the same effect as providing increased cover.

While it is understood that the existing pole may have groundline degradation that could affect the efficiency of such liner, in general terms the liner does enhance the situation. Should there be concern in aggressive environments consideration may be given to an external protective wrap as is current work practise anyway.

Casting into a permanent form (old pole) is the equivalent of being precast (control over placement). This advantage reduces concrete cover demands.

The Sika® Products and specifically their Deep Pour product are designed to address autogenous shrinkage issues. The practical limitations placed on the application of these products (i.e. thickness, etc.) are aimed at reducing all shrinkage. Concrete with shrinkage compensating properties reduces all shrinkage and that ultimately the product returns to its original placed volume. Autogenous shrinkage is only associated with cement hydration, and environmental conditions do not affect it. The magnitude is negligible and this shrinkage is not considered an issue in this application.

Temperature Fluctuation

Temperature fluctuation in the new concrete core of a reinforced pole is not considered an issue for the structural solution. The concrete column only projects approximately 250 mm above ground with the remainder all as foundation below ground. While temperatures may fluctuate, these aren't rapid changes and present no more risk than a normal pole on stub base concrete foundation.

Engineering Considerations

The fundamental engineering principal of the street light pole repair system is the combination of differing materials with a load transfer mechanism that facilitates an efficient load transfer and path.

A streetlight pole is a cantilever structure. The pole is subjected to horizontal loads (primarily wind) transverse to its length which then results in a bending moment at groundline. Similar to timber utility poles torsion loads exist but are relatively minor in magnitude with substantial inherent capacity.

The street light pole repair system is designed to withstand these bending moments and shear forces for the instances where the steel pole below groundline has corroded and lost its strength capacity. These forces will transfer from the body of the pole to the new internal reinforcement concrete pole via the designed method of connection referred to as a doweled connection. This replacement reinforced concrete column is designed to withstand the loads subjected on the pole.

The street light pole repair system is a doweled connection consisting of shear studs which transfer load from the pole shell via the studs into the new reinforced concrete column. This method of connection is designed and checked for localised stresses caused by such mechanism of load transfer. This analysis is performed by considering composite action between the concrete core and the shell of the pole:

- The concrete component is transferred to an increased steel wall thickness by modular ratio.
- The stiffness of the transformed profile is considered to determine the longitudinal shear (horizontal shear flow).
- The shear studs are sized to cope with these shear loads and are designed as concrete dowels. In this design process localised bearing stresses on the concrete are also verified.

The Connection of Concrete to Pole

The connection of the streetlight pole to the new concrete core is the critical component of the street light pole repair system. Essentially the two components are connected by friction, gravity and the locking of the segments by the taper and profile. This is no different to the sectional lap splices typically employed further up the pole with the various pole segments. However the pole becomes frangible approximately ±50 mm above groundline and the lap length is limited to 200 mm due to frangibility requirements and for this reason a doweled connection becomes a requirement. This is considered a conservative assumption for the CW0255 pole due to this pole not being perforated.

The dowel requirements can be assessed by two methods: Shear Flow and Composite Design.

The Shear Flow is the assessment of the load transfer between the pole and concrete core. This is done ignoring the taper and friction between the two components and is achieved by transforming the concrete profile to the equivalent steel profile and then employing the stiffness characteristics of the transformed profile to determine the shear flow between the two "laminates" of the profile. This Shear Flow is a direct function of the shear applied to the pole (the higher the shear the higher the shear flow).

Testing and Results

Various tests were conducted on poles reinforced by the street light pole repair system including a Proof Load test, A Serviceability Load Test, A Torsional Load Test, and Fatigue Tests over an approximately 4 month period.

Three standard, commercially available and commonly used streetlight poles, the CW0255 (6.5 m), the CW0275 (10.5 m) and the CW0276 (12.5 m) were investigated after reinforcement by the street light pole repair system. These were tested in a horizontal test rig for load ratings and in a ground vertical arrangement for failure mechanism evaluation. All the tested poles were setup so that the access door remained on the tension face of the pole to ensure a maximum achievable load at groundline. The access door is considered as a weak point on the pole and is likely to fail under compression at substantially lower loading.

CW0255 (6.5 m) Streetlight Pole

The details of the horizontal test on the CW0255 (6.5 m) pole are shown in the table in FIG. 5. The CW0255 is a 6.5 m high streetlight pole with a curved outreach. The original tests and design had been based on the assumption that frangibility is not a requirement for the 6.5 m pole. In this instance shear studs were omitted and the concrete poured up to the access door (±1.3 m above groundline).

A second version of the 6.5 m solution was aimed at providing the frangibility option and as such limits the concrete to ±200 mm above groundline but with the introduction of shear dowels.

The specimens performed adequately under the serviceability tests and there were no signs of plastic deformation or damage while the poles recovered fully to the original state. The average applied serviceability load for the 20 cycles was 12 kNm (required 7.7 kNm).

Proof Loading Tests: In all ultimate loading tests (proof loading) the various test specimens all failed within the access door of the pole and significantly higher than the rated capacity. The reinforcement rating of 12.1 kNm was comfortably achieved with a recorded failure load of 13.4 kNm achieved (failure occurred at the door). In all ultimate loading tests (proof loading) the various test specimens all failed within the access door of the pole and significantly higher than the rated capacity.

Torsional Loading Test: An average load of 0.8 kN was applied by human force to the spigot of the pole at an outreach of 1.5 m and repeated for 10 load cycles. There was zero displacement at the groundline repair and no sign of any fatigue or damage. The pole returned to its original state.

Serviceability Load Testing: The specimens performed adequately under the serviceability tests and there were no signs of plastic deformation or damage and the poles recovered fully to the original state.

CW0275 (10.5 m) Streetlight Pole

Figure 6:
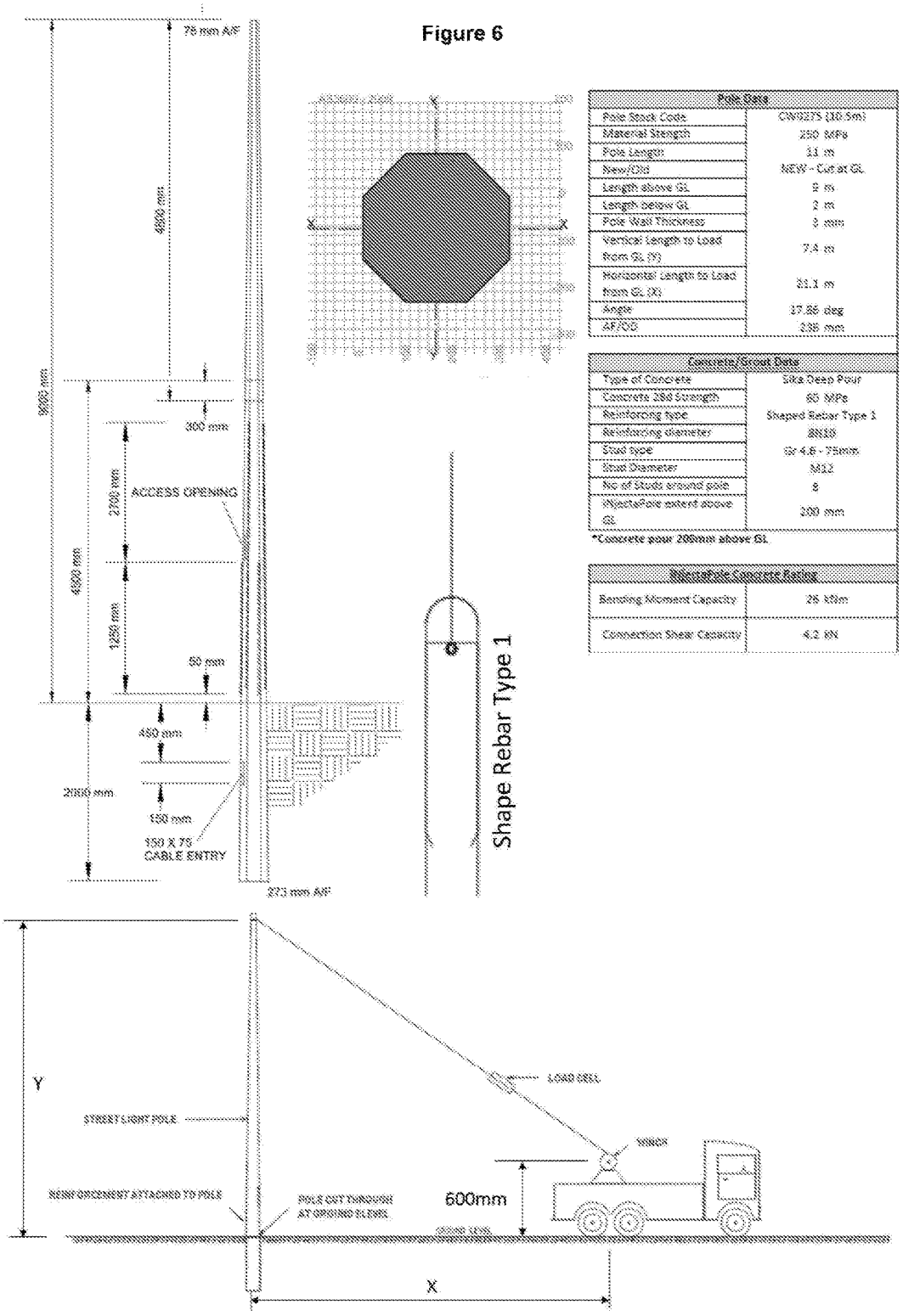
FIG. 6 shows the pole and test details for the horizontal tests conducted on the CW0275 (10.5 m) pole.

The details of the horizontal test on the CW0275 (10.5 m) pole are shown in the table in FIG. 6. The CW0275 is a 10.5 m high street light pole which can have single or double outreach luminaries. The frangibility requirement dictates that the concrete pour be limited to a maximum of 200 mm above groundline and therefore the introduction of shear dowels.

Serviceability Load Testing: The specimens performed adequately under the serviceability tests and there were no signs of plastic deformation or damage and the poles recovered fully to the original state. The average applied serviceability load for the 20 cycles was 19 kNm (required 19.0 kNm).

Proof Loading Testing: The serviceability test continued gradually until the failure load on the pole was achieved. The failure load achieved a bending moment capacity of 33.6 kNm (with 5.6 kN shear) compared to the required capacity of 34 kNm (2.44 kN shear). The failure mechanism is considered a connection failure with the bolts causing localised bearing failure together with compression failure of the walls of the frangible pole.

Torsional Loading Testing: The magnitudes of the torsional forces on a streetlight pole are considerably lower than the capacity of the efficient octagonal shaped profile. The addition of a reinforced concrete core further enhances this capacity significantly and as a result the torsional test is considered inconsequential.

CW0276 (12.5 m) Streetlight Pole

The details of the horizontal test on the CW0276 (12.5 m) pole are shown in the table in FIG. 7. The CW0276 is a 12.5 m high street light pole which can have single or double outreach luminaries. The frangibility requirement dictates that the concrete pour be limited to a maximum of 200 mm above groundline and therefore the introduction of shear dowels.

Serviceability Load Testing: The specimens performed adequately under the serviceability tests and there were no signs of plastic deformation or damage and the poles recovered fully to the original state. The average applied serviceability load for the 20 cycles was 24 kNm.

Proof Loading Testing: From the serviceability test the pole load was continued gradually until the failure on the pole was achieved. The failure mode at the external pole body that was observed was the slotted gap becoming wider and the shear stud became distorted. The load applied was 7.1 kN with estimated deflection of 850 mm. The failure bending moment was 49.4 kNm, which is about 9.9% more than the groundline bending moment capacity stated in the Western Power® Corporation test requirements.

Fatigue Test: Fatigue tests were carried out by an independent Marine Inspection Services Company to simulate the day to day repetitive loading effect on the pole to investigate the effects of fatigue on the connection. Two samples (CW0275 & CW0276) of the pole and concrete connection were issued for testing according to the associated load cycles and loads as prescribed by Western Power® Corporation (FIG. 8). The first sample (CW0275) served as a reference for the rated connection load capacity.

The fatigue tests showed zero signs of distress or deformation. It should also be noted that the eventual failure load exceeded to the rated load by 50% showing a conservative rating for the connection as would be industry norm for connection design.

While all tests were performed successfully with a single row of shear/load transfer bolts a quality control and practical decision to specify a 2 row bolt solution for the CW0275 (10.5 m) and the CW0276 (12.5 m) is preferred. This further enhances the connection by lowering localised bearing stresses and then also provides increased bracing to the frangible walls of the pole. The increased cost of a second row of bolts is minor compared to the added security it offers the connection.

The table in FIG. 9 provides some specific parameters and groundline bending moment ratings when the street light pole repair system was used on three octagonal sectional poles, the CW0255 (6.5 m), CW0275 (10.5 m) and the CW0276 (12.5 m) that are commonly used by Western Australia's Western Power® Corporation.

CONCLUSION

The street light pole repair system provides a fit for purpose, durable and practical solution for a streetlight corrosion repair. This solution offers a total reinstatement of the poles structural integrity and provides a life extension to the pole that eliminates expensive ongoing subsurface inspections of the asset. The installation technique is simple, repeatable and provides checks and balances that ensure quality assurance.

The invention claimed is:

1. A method for the reinforcement of a hollow planted pole having a metal hollow segment at least proximate to the groundline, the method comprising the steps of:

inserting in said metal hollow segment one or more reinforcement supports having a metal portion and being provided with one or more magnetic spacers;

coupling said one or more magnetic spacers to an inner wall of said metal hollow segment such that the position of the one or more reinforcement supports with respect to said metal hollow segment is maintained;

delivering a flowable composition into the metal hollow segment the flowable composition being capable of setting in the metal hollow segment to form a substantially non-flowable composition when set, such that said one or more reinforcement supports are at least partially embedded in the substantially non-flowable composition forming thereby a reinforced concrete column inside said metal hollow segment; and attaching said reinforced concrete column to the metal hollow segment with one or more shear connectors, said shear connectors are disposed with respect to said one or more reinforcement supports such that load from said metal hollow segment is transferred to said reinforced concrete column.

2. The method according to claim 1, wherein the one or more shear connectors are drilled through the exterior of the planted pole.

3. The method according to claim 2, wherein the one or more shear connectors are drilled through the exterior of the planted pole prior to the setting of the composition.

4. The method according to claim 1, wherein the one or more reinforcement supports are at least partially embedded in the substantially non-flowable composition by emplacing the one or more reinforcement supports in the flowable composition in the hollow prior to the setting of the composition.

5. The method according to claim 1, wherein the one or more reinforcement supports are at least partially embedded into the substantially non-flowable composition by emplacing the one or more reinforcement supports in the hollow prior to delivering the flowable composition into the hollow.

6. The method according to claim 1, wherein the one or more reinforcement supports comprise steel bars.

7. The method according to claim 1, wherein the one or more reinforcement supports are emplaced substantially vertical and at approximately regular intervals adjacent to the circumference of the hollow of the planted pole and proximate to the groundline.

8. The method according to claim 1, wherein the hollow comprises an internal wall, and the distance between the one or more reinforcement supports and the internal wall of the hollow is less than approximately 15 mm.

9. The method according to claim 1, wherein the one or more magnetic spacer attach the one or more reinforcement supports to the internal wall of the hollow.

10. The method according to claim 9, wherein the one or more magnetic spacers comprise a ring through which at least a portion of a reinforcement support can be inserted.

11. The method according to claim 1, wherein the one or more reinforcement supports comprise steel bars having a diameter of between approximately 6 mm and 36 mm.

12. The method according to claim 1, wherein the one or more reinforcement supports comprise 500 MPa steel reinforcing bars.

13. The method according to claim 1, wherein the flowable composition comprises high strength and low shrinkage concrete and/or grout.

14. The method according to claim 13, wherein the concrete has a high strength of at least 50 MPa.

15. The method according to claim 13, wherein the concrete and/or grout comprises corrosion inhibitors.

16. The method according to claim 13, wherein the concrete and/or grout is poured in two sections comprising:

a first bottom pour of concrete and/or grout into the hollow;

and a second upper pour of concrete and/or grout into the hollow on to the first bottom pour.

17. The method according to claim 1, wherein the composition is delivered to a minimum height within the hollow of the planted pole of approximately 200 mm from the groundline.

* * * * *